US006030247A

United States Patent [19]

Sasahara

[11] Patent Number: 6,030,247

[45] Date of Patent: Feb. 29, 2000

[54] POWER-SUPPLY ADAPTER DEVICE

[75] Inventor: Yasumasa Sasahara, Hamamatsu, Japan

[73] Assignee: Yamaha Corporation, Hamamatsu, Japan

[21] Appl. No.: 09/010,604

[22] Filed: Jan. 22, 1998

[30] Foreign Application Priority Data

Jan. 28, 1997 [JP] Japan ..... 9-14211

[51] Int. Cl.[7] ..... H01R 4/50

[52] U.S. Cl. ..... 439/332; 439/79; 439/956

[58] Field of Search ..... 439/501–502, 439/79, 505, 638, 650, 655, 332–337, 956

[56] References Cited

U.S. PATENT DOCUMENTS

| | | | |
|---|---|---|---|
| 5,205,749 | 4/1993 | Weingartner | 439/332 X |
| 5,577,923 | 11/1996 | Lee | 439/956 X |
| 5,720,628 | 2/1998 | Usui et al. | 439/956 X |
| 5,855,064 | 1/1999 | Chang | 439/638 X |

*Primary Examiner*—Khiem Nguyen
*Attorney, Agent, or Firm*—Pillsbury Madison & Sutro LLP

[57] ABSTRACT

Secondary-power output cable is detachably coupled to an adapter body via a cable connector. The cable connector includes a jack provided on the adapter device and a plug attached to the output cable. The jack and plug have respective engaging mechanisms that cooperate to provide an interlocking mechanism to prevent the output cable from being accidentally decoupled from the adapter body. To provide the interlocking mechanism, the plug has an outward projection formed on the outer surface thereof and the jack has a plug hole for insertion of the plug and an entry recess formed in the inner surface of the jack defining the plug hole, so that the plug can be introduced into the jack only in a particular angular position. The outward projection of the plug is brought into engagement by a locking recessed portion, formed in the inner surface of the jack, by rotating the plug after insertion into the plug hole. This way, a power-supply adapter device is achieved which can be produced with increased productivity at reduced costs and yet is easy to handle.

11 Claims, 6 Drawing Sheets

POWER-SUPPLY ADAPTER DEVICE

BACKGROUND OF THE INVENTION

The present invention relates to power-supply adapter devices for converting commercial AC (Alternating Current) power into DC (Direct Current) power and supplying the converted DC power to desired loads or external equipment such as electronic musical instruments, telephones and notebook-type personal computers.

Generally, power-supply adapter devices comprise an adapter body, a primary-power input cable for coupling to a commercial AC power supply and a secondary-power output cable for coupling to a desired load or external equipment. Among such known power-supply adapter devices is one where the primary-power input cable is detachably coupled to the adapter body with the secondary-power output cable integrally fixed to the adapter body.

However, the fixed connection, to the adapter body, of the secondary-power output cable would present the following disadvantages. Namely, because the secondary-power output cable terminates in a cable connector that may vary from one type to another depending on requirements of external equipment to be coupled therewith, and thus it is necessary to take into account possible requirements of external equipment prior to and during production of the power-supply adapter device. Because a different type of cable connector is normally required for a different type of external equipment, the power-supply adapter device must be produced in such a manner to allow various types of output cable to be properly connected therewith, which would inevitably lead to high costs and low productivity. Further, the cable integrally fixed to the adapter body tends to become an obstacle in carrying or storing the adapter device.

SUMMARY OF THE INVENTION

It is therefore an object of the present invention to provide a power-supply adapter device which can be produced with increased productivity at reduced costs and yet is easy to handle.

According to an aspect of the present invention, there is provided a power-supply adapter device, which comprises an adapter body having a primary-power input terminal to receive commercial AC power and a secondary-power output terminal to generate converted DC power, and an output cable connected to the secondary-power output terminal of the adapter body, and which is characterized in that the output cable is detachably coupled to the adapter body by means of a cable connector, rather than being integrally fixed to the adapter body.

Preferably, the above-mentioned cable connector includes an interlocking mechanism to prevent the output cable from being accidentally decoupled from the adapter body.

In a specific preferred implementation, the cable connector includes a jack provided on the adapter body and a plug connected to the output cable, and the plug has an outward projection formed on the outer surface thereof. The jack has a plug hole for insertion of the plug, an entry recess formed in the inner surface of the jack defining the plug hole so that the outward projection of the plug is guided through the entry recess when the plug is moved in or out of the plug hole, and a locking recessed portion formed in the inner surface of the jack. The outward projection of the plug is brought into engagement by the locking recessed portion by rotating the plug after insertion into the plug hole.

By provision of such a cable connector permitting detachable coupling, to the adapter body, of the output cable, the power-supply adapter device according to the present invention can be produced by a single production line with uniform standards, without a particular need to take into account possible loads or external equipment prior to and during production. Thus, increased productivity and reduced costs can be achieved. Further, by decoupling the secondary-power output cable from the adapter body, the adapter device can be carried and stored in a narrow space with utmost ease. When shipping the adapter device, the output cable may be either in a coupled condition or in a decoupled condition.

Further, by provision of the interlocking mechanism in the cable connector, accidental decoupling of the output cable can be reliably prevented against unexpected external force applied during use, and the adapter device can be protected from such external force to a considerable degree although the output cable is of the detachable type.

Furthermore, a substantial increase in the overall size of the cable connector due to the provision of the interlocking mechanism can be effectively avoided because of the above-mentioned structure of the cable connector.

BRIEF DESCRIPTION OF THE DRAWINGS

For better understanding of the above and other features of the present invention, the preferred embodiments of the invention will be described in greater detail hereinbelow with reference to the accompanying drawings, in which.

DETAILED DESCRIPTION OF THE PREFERRED EMBODIMENTS

Figure 1:
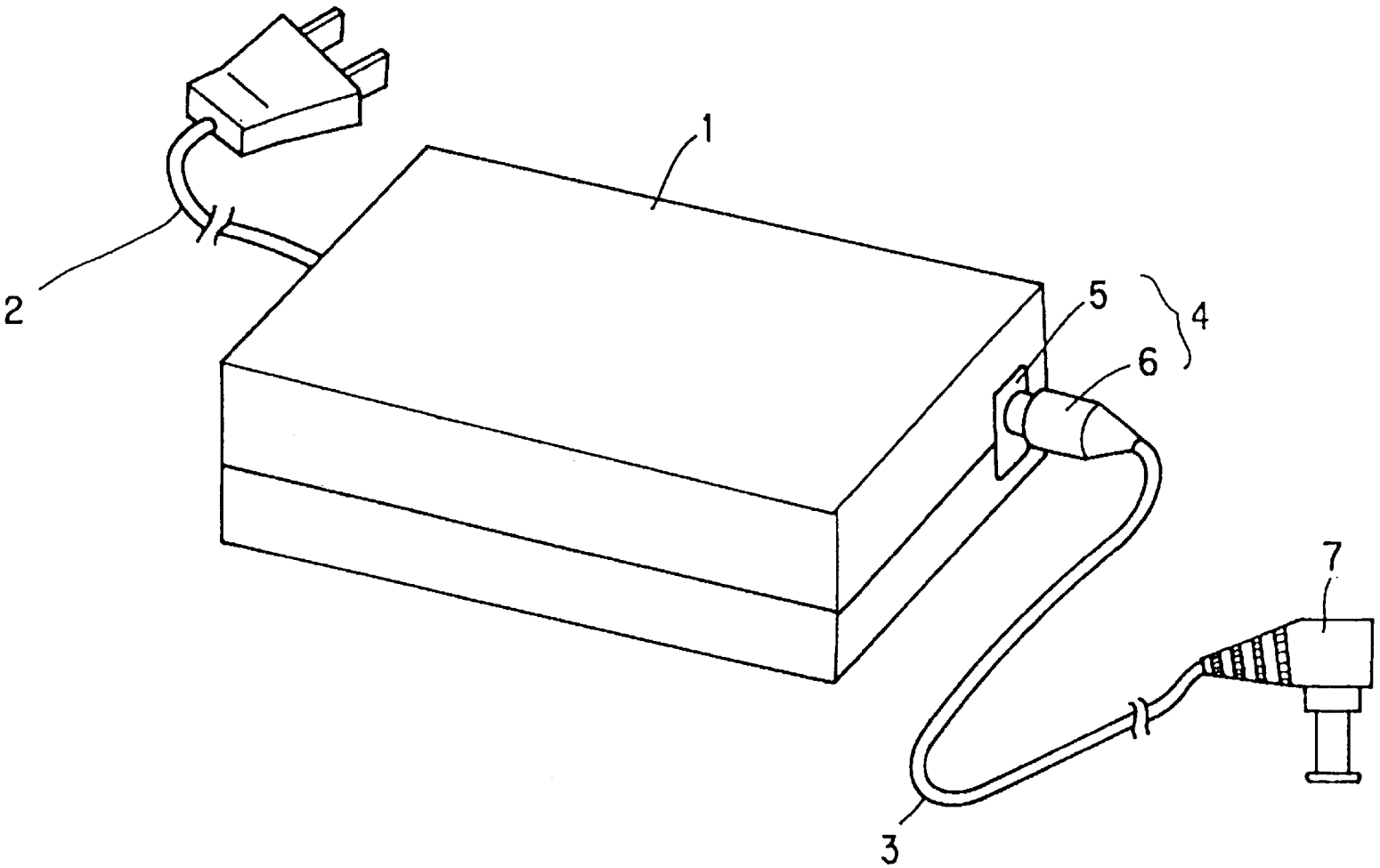
FIG. 1 is a perspective view of a power-supply adapter device in accordance with an embodiment of the present invention.

FIG. 1 is a perspective view of a power-supply adapter device in accordance with an embodiment of the present invention, which comprises an adapter body 1, a primary-power input cable 2 for introducing commercial AC power to the adapter body 1, and a secondary-power output cable 3 for supplying a desired load or external equipment with converted DC output from the adapter body 1. In this embodiment, the primary-power input and secondary-power output cables 2 and 3 are both detachably coupled to the adapter body 1.

Cable connector 4 for detachably coupling the output cable 3 to the adapter body 2 includes a jack 5 provided on the adapter body 1, and a plug 6 provided at an end of the output cable 3 for insertion into the jack 5. At the other end of the cable 3, there is provided a conventional-type plug 7 for coupling with external equipment (not shown).

The jack 5 and plug 6 are fitted with respective engaging mechanisms that cooperate to provide an interlocking mechanism to prevent the output cable 3 from being accidentally detached from the adapter body 2, as shown in detail in FIGS. 2 an 3.

Figure 2B:
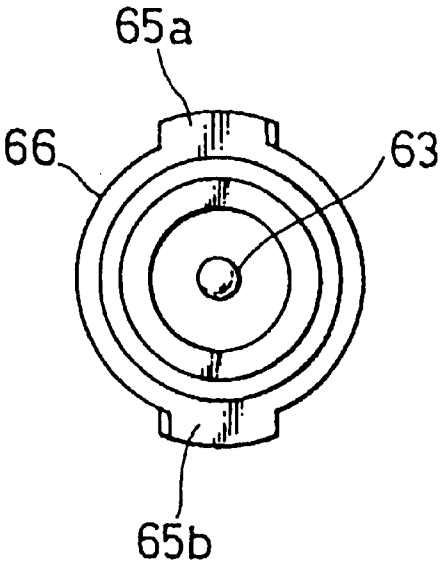
FIGS. 2A and 2B are side and front views, partly cut away, of an end structure of a plug employed in the embodiment.
Figure 2A:
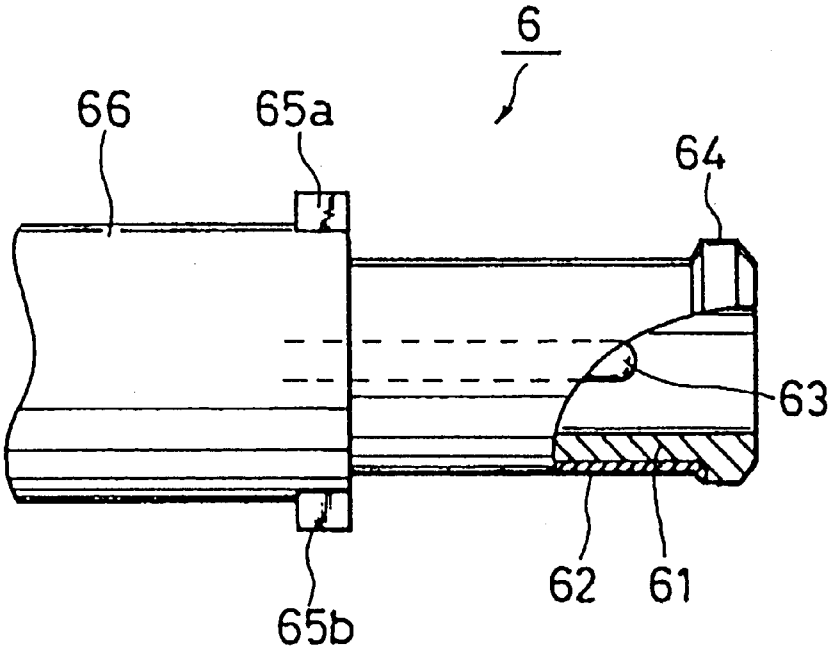

FIGS. 2A and 2B are side and front views, partly cut away, of an end structure of the plug 6, which includes a cylindrical body 61 made of a resin material and a pin 63 functioning as an electrical conductor extending centrally through the cylindrical body 61. An external conductive member 62 in a cylindrical shape is disposed around the outer surface of the central conductor pin 63. The cylindrical body 61 has, at one or distal end thereof, an annular flange portion 64 integrally formed therewith. Further, the plug 6 is connected, at the other end, with the output cable 3 by means of a cylindrical connecting portion 66 made by molding of a resin material. The resin-made connecting portion 66 has, at one of its ends closer to the annular flange portion 64, two arcuate outward projections 65*a* and 65*b* that are integrally formed with the outer surface of the connecting portion 66 and disposed in diametrically opposite relation to each other, so as to provide the locking mechanism of the plug.

Figure 3A:
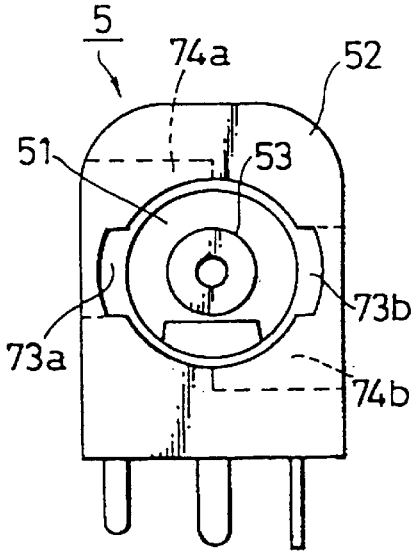
FIG. 3A is a front view of a jack according to an embodiment of the present invention.
Figure 3B:
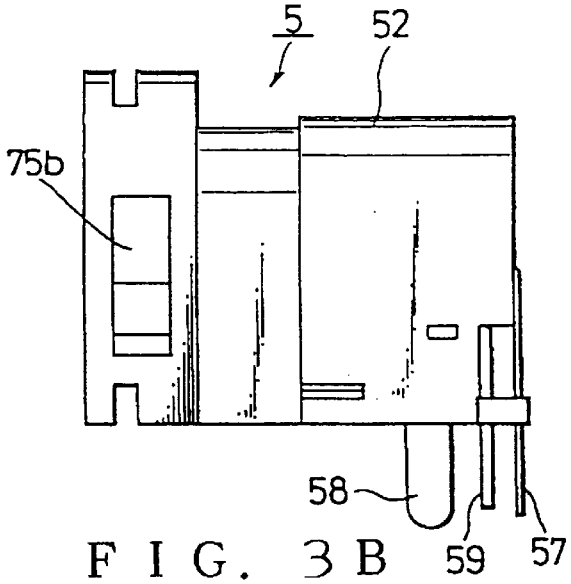
FIG. 3B is a side view of a jack according to an embodiment of the present invention.
Figure 3C:
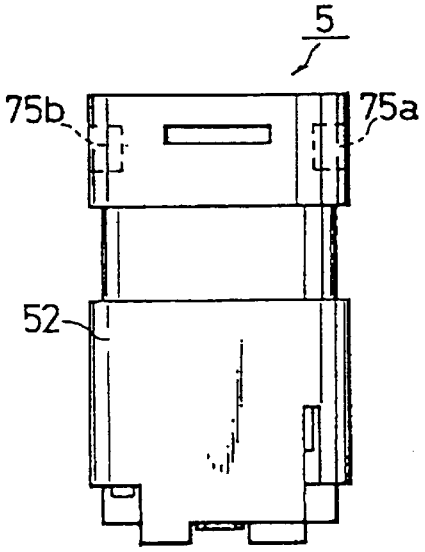
FIG. 3C is a plan view of a jack according to an embodiment of the present invention.
Figure 3D:
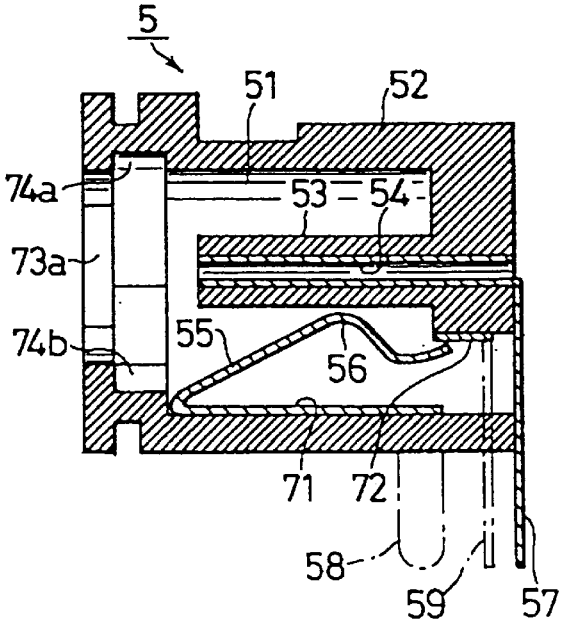
FIG. 3D is a side sectional view of a jack according to an embodiment of the present invention.

FIGS. 3A, 3B and 3C are front, side and plan views, respectively, of the jack 5, and FIG. 3D is a sectional side view of the jack 5. The jack 5 comprises a body 52 that is made by molding of a resin material and has a plug hole 51 formed therein. The resin-made jack body 5 includes a cylinder-shaped pin receiving portion 53 that is formed integrally therewith in co-axial relation to the plug hole 51 and has a pin hole 50 for insertion therein of the central conductor pin 63 of the plug 6. An electrically conductive member 54 is disposed, along the inner surface of the pin receiving portion 53, for electrical connection with the central conductive pin 63 of the plug 6 inserted in the jack 5. Further, in a recessed portion 71 communicating with the plug hole 51 of the resin-made jack body 52, there is fitted a resilient terminal piece 55 that comes into resilient contact with the external conductive member 62 when the plug 6 is inserted into the jack 5.

The resilient terminal piece 55 comprises a steel plate generally in an acute dogleg shape; that is, one of its two straight portions is fixed to the bottom of the recessed portion 71 and the other of its straight portions extends obliquely over the one straight portion to provide a resilient resistive force against insertion, into the jack 5, of the plug 6. The obliquely extending straight portion of the terminal piece 55 terminates in a chevron-shaped hook 56 that comes into resilient engagement with the above-mentioned annular flange portion 64 as the plug 6 is inserted into the jack 5 against the resilient resistive force.

The internal conductive member 54 and resilient terminal piece 55 are connected to lead terminals 57 and 58, respectively, which are in turn coupled to internal circuitry of the adapter body 1. Further, an electrically conductive protecting member 72 is disposed on part of the surface of the jack body 52 which the distal end of the resilient terminal piece 55 would intermittently abut against during coupling or decoupling of the plug 6 to or from the jack 5. This conductive protecting member 72 is also connected to a lead terminal 59.

Figure 4:
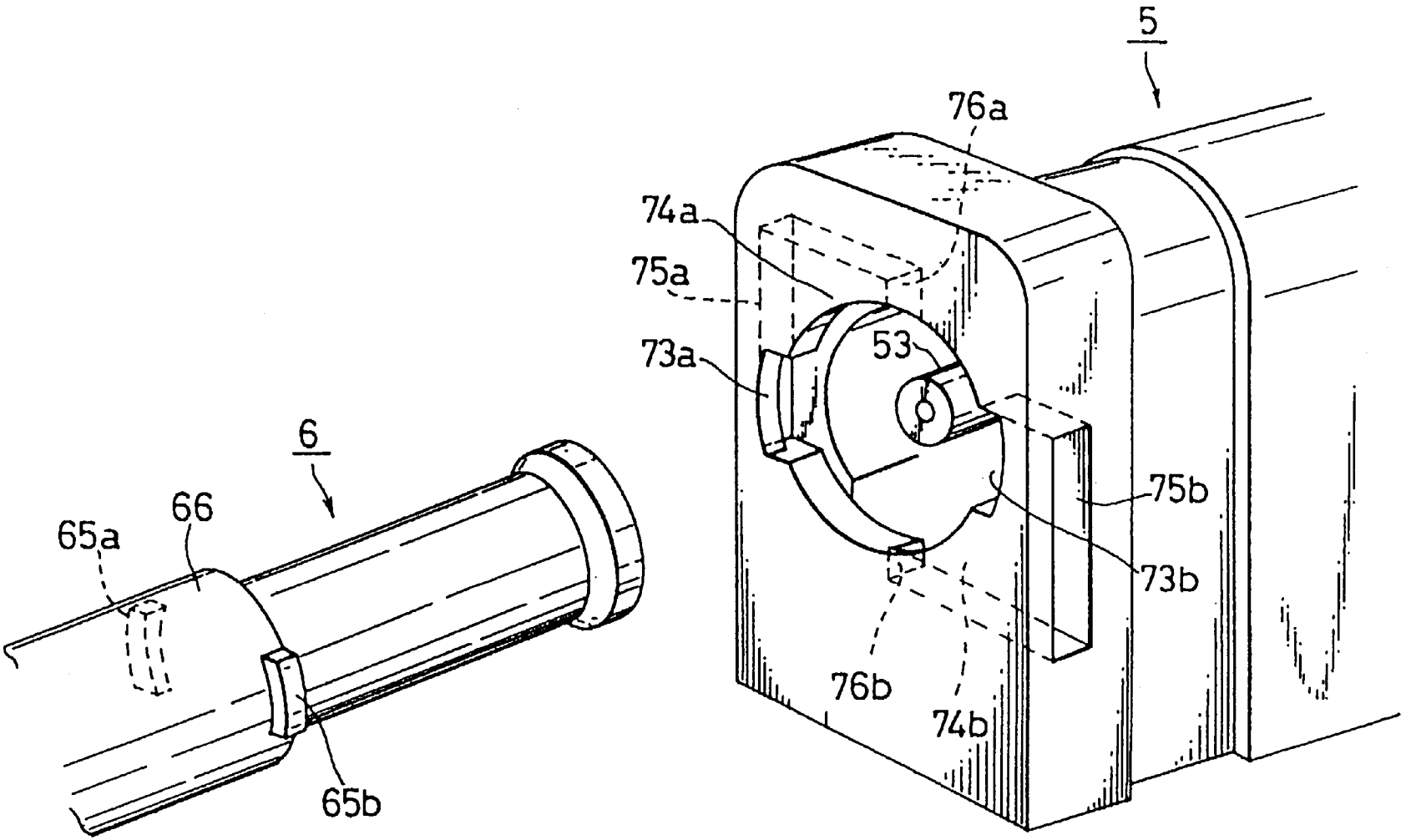
FIG. 4 is a perspective view showing the plug before it is inserted into the jack.
Figure 5:
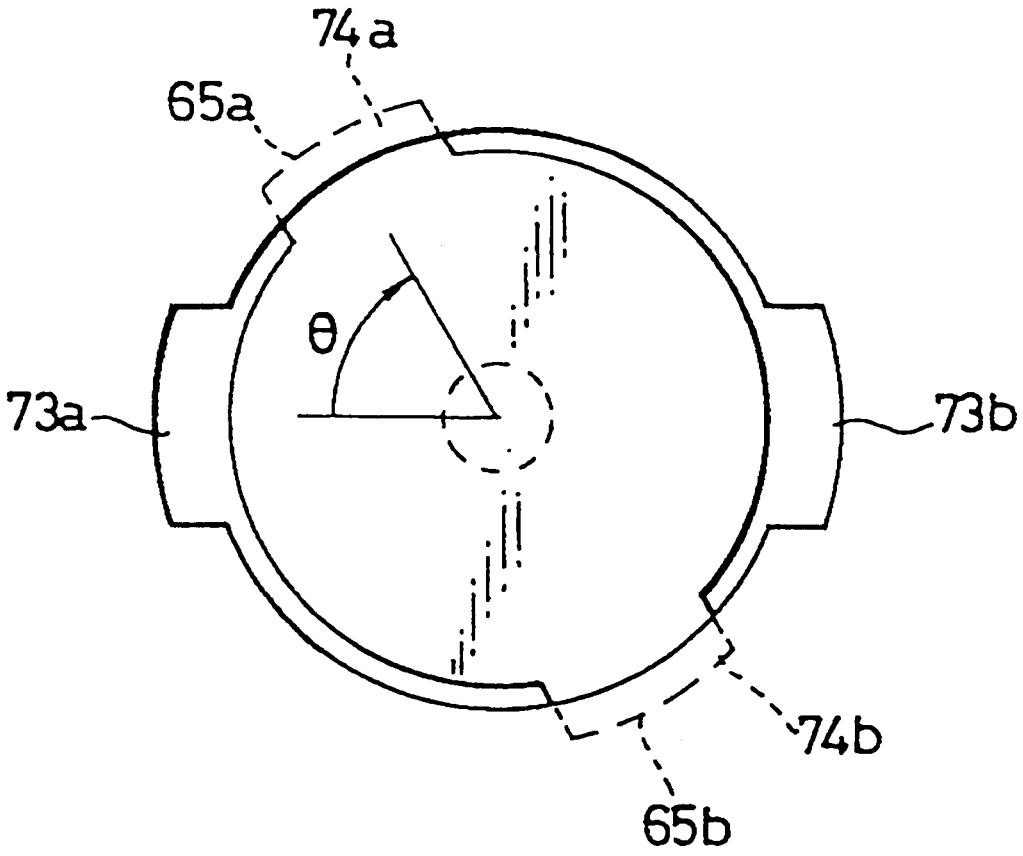
FIG. 5 is a view showing the plug and the jack in locking engagement with each other.

As seen in FIGS. 3A and 3B, two arcuate entry recesses 73*a* and 73*b* are formed, in the inner surface of the jack 5 defining the plug hole 51, for snugly receiving the outward projections 65*a* and 65*b*, respectively, when the plug 6 is inserted in the jack 6. Thus, the plug 6 can be properly coupled to the jack 5 only in a particular angular position where the outward projections 65*a* and 65*b* are allowed to be guided through the entry recesses 73*a* and 73*b*, as clearly seen in a perspective view of FIG. 4. In addition, locking recessed portions 74*a* and 74*b* are formed in inner surface of the jack body 52 rearwardly of the entry recesses 73*a* and 73*b* and extend beyond the upper and lower ends of the respective entry recesses 73*a* and 73*b* in such a manner that the outward ward projections 65*a* and 65*b* passed through the entry recesses 73*a* and 73*b* are brought into engagement with the locking recessed portions 74*a* and 74*b* by rotating the inserted plug 6 clockwise. The locking recessed portions 74*a* and 74*b* communicate with the respective entry recess 73*a* and 73*b* and have outward openings 75*a* and 75*b* in the opposite side surfaces of the jack body 52. Each of the locking recessed portions 74*a* and 74*b* also has a stopper surface 76*a*, 76*b* to limit the rotating movement of the corresponding outward projection 65*a*, 65*b* and hence of the plug 6. Namely, as shown in FIG. 5, by rotating the inserted plug 6 in the clockwise direction only through angle θ as defined by the stopper surfaces 76*a* and 76*b*, the outward projections 65*a* and 65*b* of the plug 6 are engaged by the locking recessed portions 74*a* and 74*b* in such a manner that the plug 6 is reliably prevented from being decoupled from the jack 5 unless it is positively rotated in the counter-clockwise direction.

Figure 6A:
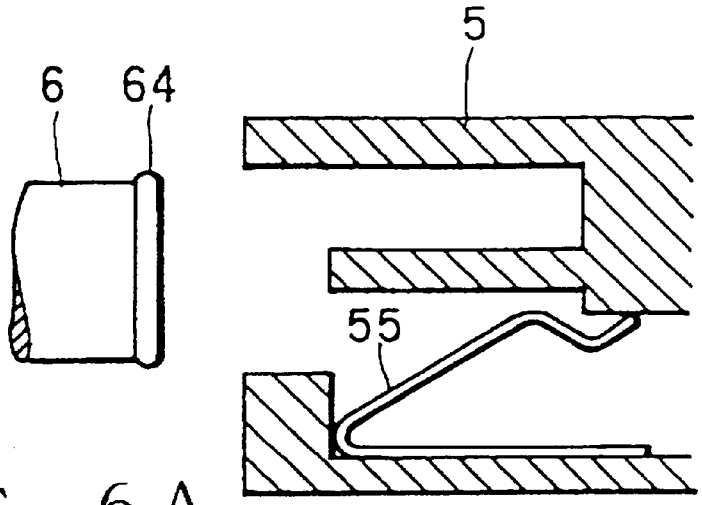
FIG. 6A is a side sectional view of a jack prior to coupling with a plug.
Figure 6B:
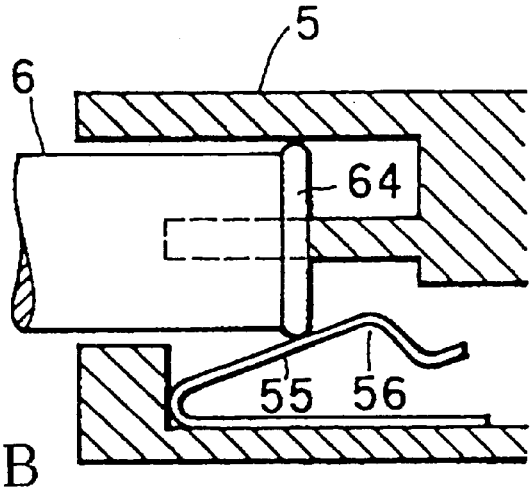
FIG. 6B is a side sectional view of a jack during partial coupling with a plug.
Figure 6C:
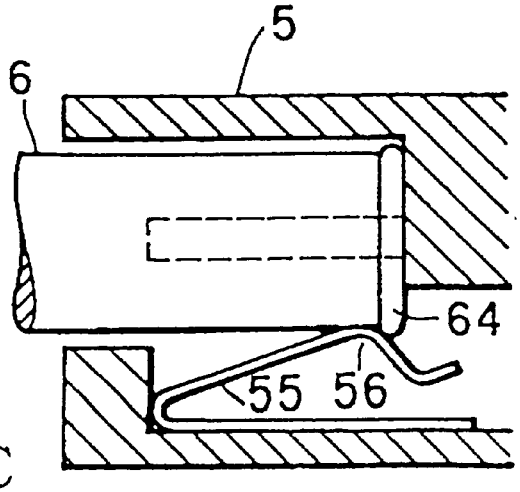
FIG. 6C is a side sectional view of a jack after full coupling with a plug.

FIGS. 6A to 6D are sectional views showing a manner in which the plug 6 is coupled to the jack 5 in the present embodiment. As the plug 6 is initially pushed into the plug hole 51 of the jack 5 from the non-coupled condition of FIG. 6A, the annular flange portion 64 disposed at the distal end of the plug 6 slides along the obliquely-extending straight portion of the resilient terminal piece 55 against the resilient force thereof as shown in FIG. 6B. Then, as the distal end surfaces of the plug 6 reaches the end (bottom) of the plug hole 51, the annular flange portion 64 travels over the peak point of the chevron-shaped hook 56 of the terminal piece 55 and thus is brought into light locking engagement by the hook 56.

In summary, the power-supply adapter device according to the above-described embodiment is characterized in that the secondary-power output cable 3 is detachably connected to the adapter body 1 by means of the cable connector 4 and the cable connector 4 includes the jack 5 and plug 6 provided with engaging mechanisms to prevent accidental decoupling, from the adapter body 2, of the output cable 3. Therefore, unlike the conventional power-supply adapter devices having their output cables integrally fixed the adapter body, the power-supply adapter device of the present invention can be produced with increased efficiency by a single production line. Further, by decoupling the secondary-power output cable 3 from the adapter body 3, the adapter device can be carried and stored in a narrow space with utmost ease. In addition, because accidental decoupling of the output cable 3 can be reliably prevented by the interlocking mechanism, the adapter device can be protected against external force to a considerable degree although the output cable is of the detachable type. Furthermore, a substantial increase in the overall size of the cable connector 4 can be avoided because the interlocking mechanism is snugly accommodated within the jack 5.

By virtue of the arrangement that the output cable is detachably coupled to the adapter body, the present invention provides a superior power-supply adapter device which can be produced with increased productivity at reduced costs and yet is easy to handle.

What is claimed is:

1. A power-supply adapter device comprising:

an adapter body having a primary power input terminal to receive commercial AC power and a secondary-power output terminal to generate converted DC power; and an output cable connected to said secondary-power output terminal of said adapter body, said output cable being detachably coupled to said adapter body by a cable connector, wherein said cable connector includes a jack provided on said adapter body and a plug connected to said output cable, said plug has an outward projection formed on an outer surface thereof, and said jack has a plug hole for insertion of said plug, and an entry recess formed in an inner surface of said jack defining the plug hole so that the outward projection of said plug is guided through the entry recess when said plug is moved in or out of said plug hole, and a locking recessed portion formed in the inner surface of said jack, the outward projection of said plug being brought into engagement by said locking recessed portion by rotating said plug after insertion into the plug hole.

2. The power-supply adapter device according to claim 1, wherein the plug includes a central conductor pin and an external conductive member in a cylindrical shape disposed around an outer surface of the central conductor pin.

3. The power-supply adapter device according to claim 1, wherein the jack has a body portion that includes a cylinder-shaped pin receiving portion that is formed integrally with the body portion and in co-axial relation to the plug hole and has a pin hole for insertion therein of a central conductor pin of the plug.

4. The power-supply adapter device according to claim 3, wherein an electrically conductive member is disposed along an inner surface of the pin receiving portion for electrical connection with the central conductive pin.

5. The power supply adapter device according to claim 1, wherein a resilient terminal piece is fitted in a recessed portion of the jack in communication with the plug hole, the resilient terminal piece capable of being in resilient contact with an external conductive member of the plug when the plug is inserted into the jack.

6. The power supply adapter device according to claim 5, wherein the resilient terminal piece comprises a steel plate in a generally acute dogleg shape.

7. The power supply adapter device according to claim 4, wherein the electrically conductive member is electrically connected to a lead terminal.

8. The power supply adapter device according to claim 5, wherein the resilient terminal piece is electrically connected to a lead terminal.

9. The power supply adapter device according to claim 5, wherein an electrically conductive protecting member is disposed in the recessed portion of the jack, against which a distal end of the resilient terminal piece is adapted to abut during coupling or decoupling of the plug to or from the jack.

10. The power supply adapter according to claim 9, wherein the electrically conductive protecting member is electrically connected to a lead terminal.

11. The power supply adapter according to claim 1, wherein an annular flange portion is at a distal end of the plug adapted for light locking engagement with a chevron-shaped hook of a resilient terminal piece of the jack.

* * * * *